US005219453A

United States Patent [19]

Furukawa et al.

[11] Patent Number: 5,219,453

[45] Date of Patent: Jun. 15, 1993

[54] SHEET BINDER

[75] Inventors: Hideaki Furukawa, Yokohama; Naoki Fuei, Kawaguchi; Norio Hikake; Kimiaki Hayakawa, both of Yokohama; Shuichi Yabe, Kawasaki, all of Japan

[73] Assignees: Canon Kabushiki Kaisha, Tokyo; Canon Aptex Inc., Ibaraki, both of Japan

[21] Appl. No.: 688,272

[22] Filed: Apr. 22, 1991

[30] Foreign Application Priority Data

| | | | |
|---|---|---|---|
| Apr. 23, 1990 | [JP] | Japan | 2-108515 |
| Apr. 23, 1990 | [JP] | Japan | 2-108516 |
| Apr. 23, 1990 | [JP] | Japan | 2-108517 |
| Apr. 23, 1990 | [JP] | Japan | 2-108518 |
| Apr. 23, 1990 | [JP] | Japan | 2-108519 |
| Apr. 23, 1990 | [JP] | Japan | 2-108520 |

[51] Int. Cl.[5] ..... B42B 5/00

[52] U.S. Cl. ..... 412/33; 412/21; 412/902; 156/274.8

[58] Field of Search ..... 281/21.1; 412/33, 900, 412/902, 21; 156/274.8, 274.6, 275.7, 305, 380.9

[56] References Cited

U.S. PATENT DOCUMENTS

| | | | |
|---|---|---|---|
| 2,968,336 | 1/1961 | Martin et al. | 281/21.1 X |
| 3,093,396 | 6/1963 | Segreto | 281/21.1 X |
| 3,964,769 | 6/1976 | Shatzkin | 281/21.1 |
| 4,009,498 | 3/1977 | Staats et al. | 412/900 X |
| 5,035,561 | 7/1991 | Loibl | 412/900 X |

FOREIGN PATENT DOCUMENTS

| | | | |
|---|---|---|---|
| 379838 | 8/1990 | European Pat. Off. | 412/33 |

*Primary Examiner*—Mark Rosenbaum
*Assistant Examiner*—William Fridie, Jr.
*Attorney, Agent, or Firm*—Fitzpatrick, Cella, Harper & Scinto

[57] ABSTRACT

A sheet binder for binding sheets by adhering the sheets to a back of a cover member by a heat-fusible adhesive. The sheet binder includes a supporting member for supporting the cover member having the back, to an inner surface of which the heat-fusible adhesive is applied, a heat generating member disposed in the proximity of the supporting member, and an alternate magnetic field generating device for generating an alternate magnetic field to heat the heat generating member.

19 Claims, 12 Drawing Sheets

CHARACTER OF MAGNETIC BODY (at 20 KHz)

| MAGNETIC BODY | SPECIFIC RESISTANCE ρ ( Ω·m) | RELATIVE PERMEABILTY μr | SURFACE RESISTANCE Rs( Ω ) | DEPTH OF PERMEATION δ (m) |
|---|---|---|---|---|
| IRON | $9.8 \times 10^{-8}$ | 100 | $8.9 \times 10^{-4}$ | $0.11 \times 10^{-3}$ |
| 18 - 0 STEINLESS | $6.0 \times 10^{-7}$ | 100 | $21.0 \times 10^{-4}$ | $0.28 \times 10^{-3}$ |

MOS-FET WAVE CONFIGURATION

SHEET BINDER

BACKGROUND OF THE INVENTION

1. Field of the Invention

The present invention relates to a sheet binder, and a cover member used when sheets are bound.

2. Related Background Art

In the past, example of sheet binders for binding a plurality of sheets by taking advantage of fusion and solidification of an adhesive, there has been proposed a sheet binder wherein an adhesive is applied onto an inner surface of the back of a cover member and then a plurality of sheets to be bound are inserted inside of the cover member, whereby the sheets are bound together with the cover by fusing the adhesive by application of heat.

Such a conventional sheet binder comprised nichrome wires acting as a heating means for fusing the adhesive, a heat generating means such as a sheet-like heat generating body, a heat plate for supporting the heat generating body, holding the cover member and transmitting the heat from the heat generating body to the cover member, and an insulator for electrically insulating the heat generating means from the heat plate.

However, in the above-mentioned conventional sheet binder, as the size of the sheet to be bound was increased and as the thickness of the sheet bundle to be bound was increased, the heat plate had to be so designed that its surface area, its strength for holding the cover and its thickness also were more increased. As a result, the heat capacity of the heat plate was also increased, and it took a long time to attain a predetermined temperature (about 150° C.) required for fusing the adhesive.

Thus, if the conventional heating means such as a surface heater was used, since the productivity of the initial sheet binding operation was extremely reduced and the heating value (heat amount) of the heat generating body became great, there arose a problem that an additional protection device must be provided for protection purpose so that the binder becomes bulky due to the larger capacity of the electric power source.

Further, since the heat fusible adhesive was heated via the cover member, the heat conductivity was worsened and cover materials having a poor heat resistance could not be used. In addition, if a cover member made of normal paper was used, since the heat conductivity thereof was changed in accordance with its thickness, in order to compensate for the change in heat conductivity in terms of safety, the heating time had to be longer.

SUMMARY OF THE INVENTION

An object of the present invention is to eliminate the above-mentioned conventional drawbacks, that is, to provide a sheet binder which can reduce a time period to reach a temperature for fusing an adhesive, make the whole binder small-sized and permit the use of a cover material having a poor heat resistance.

Another object of the present invention is to provide a sheet binder for binding sheets by a heat-fusible adhesive applied onto a back of a cover member, comprising a supporting member for supporting the cover member having a back to an inner surface of which the adhesive is applied, a heat generating member disposed in the proximity of the supporting member, and an alternate magnetic field generating means for generating an alternate magnetic field to heat the heat generating member.

DETAILED DESCRIPTION OF THE PREFERRED EMBODIMENTS

The present invention will now be explained in connection with embodiments thereof with reference to the accompanying drawings.

Figure 1:
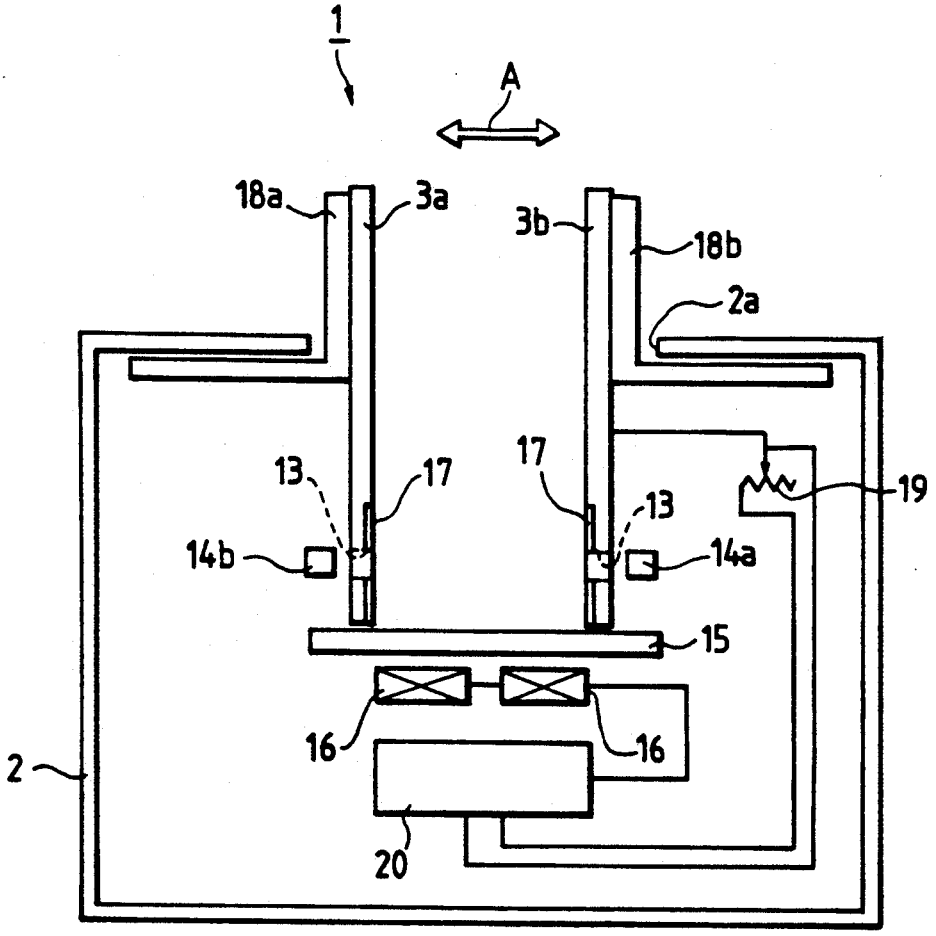
FIG. 1 is an elevational sectional view of a sheet binder according to a preferred embodiment of the present invention.
Figure 2:
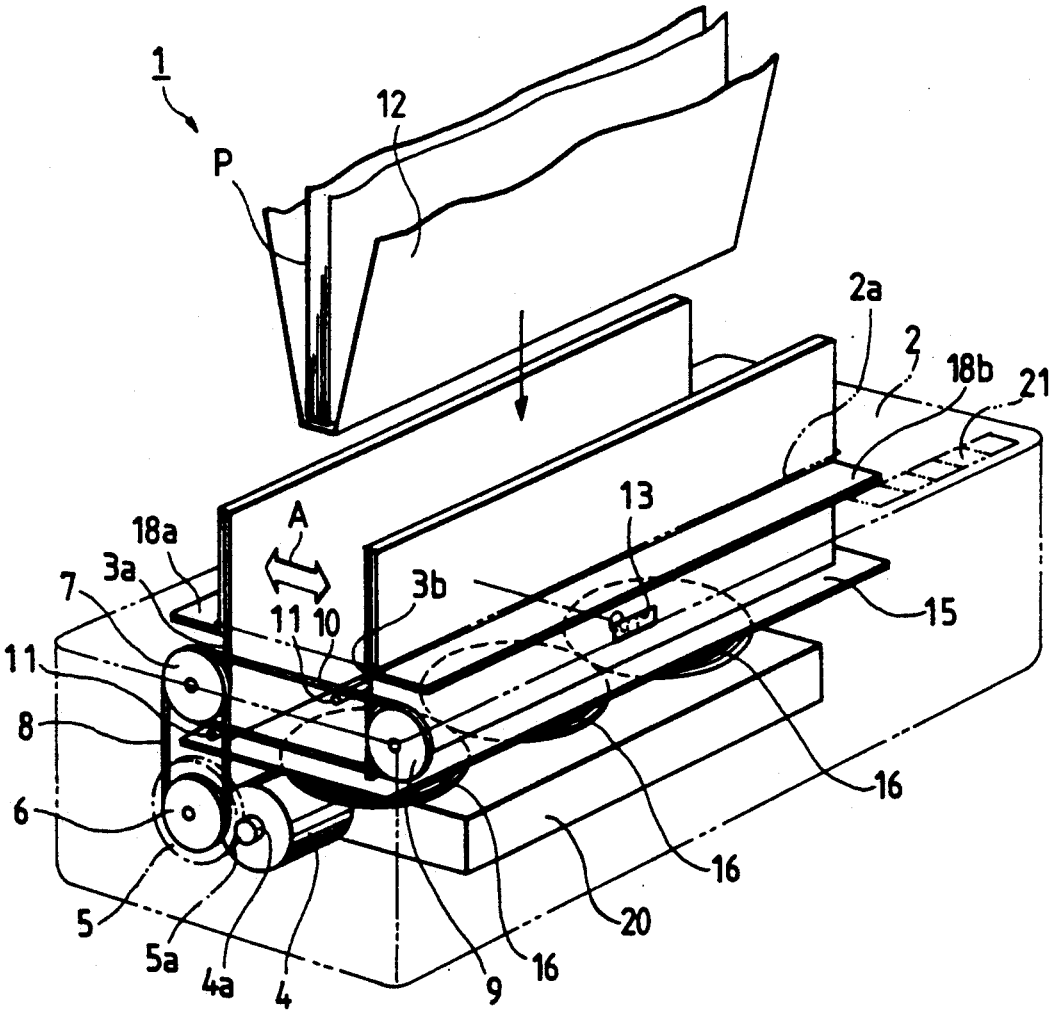
FIG. 2 is a perspective view of the sheet binder of FIG. 1.

In FIGS. 1 and 2, a sheet binder 1 has vertical flat guide plates **3*a* and 3*b* spaced in parallel and mounted within an upper opening 2*a* of a box-like body frame 2 for movement toward and away from each other in a direction shown by the arrow A. The guide plates 3*a*, 3*b*** may be made of heat-resistive non-magnetic material such as plastics.

A motor 4 for driving the guide plates **3*a*, 3*b* is arranged at the left (FIG. 2) part of the body frame 2, and a pinion 4*a* of the motor is meshed with a gear 5*a* of a torque limiter 5. A pulley 6** disposed on the torque limiter 5 is connected to an upper pulley 7 via a belt 8, and the upper pulley 7 is connected to a corresponding pulley 9 via a belt 10. Projections 11 formed on the guide plates 3a and 3b are fixed to lower and upper runs of the belt 10, respectively.

When the motor 4 is rotated in a normal direction, the guide plates 3a, 3b are moved to approach each other through the pinion 4a, torque limiter 5, pulley 6, belt 8, pulley 7 and belt 10, so that the guide plates 3a, 3b pinch a cover member 12 and sheets P therebetween to apply a predetermined pressure to them. When the pressure exceeds the predetermined value, the guide plates do not further compress the sheets and cover member due to slip in the torque limiter. Similarly, when the motor is rotated in a reverse direction, the guide plates are moved to separate from each other.

A pair of magnetic bodies (for example, iron) 17 heated by an alternate magnetic field are attached to the guide plates 3a, 3b, respectively. Further, notches 13 are formed in the guide plates 3a, 3b, respectively, and a light emitter 14a and a light receiver 14b are opposed through these notches 13.

In the proximity of lower portions of the guide plates 3a, 3b, a high heat-resistive nonmagnetic plate 15 (for example, made of ceramics) permeable to the magnetic field is disposed horizontally, and alternate magnetic field generation coils 16 are arranged below the plate 15. Further, L-shaped ferrite members 18a, 18b having high permeability are attached to the outer sides of the guide plates 3a, 3b, respectively, to prevent the occurrence of electromagnetic trouble due to leakage of the alternate magnetic field. Horizontal portions of the ferrite members 18a, 18b slidably contact with an undersurface of the upper wall of the body frame 2.

A variable resistor 19 having its resistance value changed in accordance with the shifting amount of the guide plates 3a, 3b depending upon a thickness of the cover member 12 sandwiching the sheets P is provided, and a control portion 20 for controlling various electric equipment is disposed on the bottom of the body frame 2. Incidentally, reference numeral 21 denotes a display.

Figure 3A:
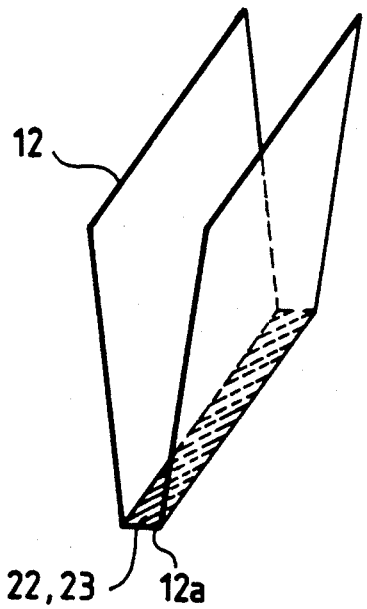
FIG. 3A is a perspective view of a cover assembly.
Figure 3B:
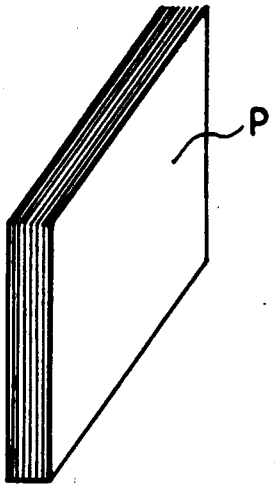
FIG. 3B is a perspective view of a bundle of sheets to be bound.
Figure 4:
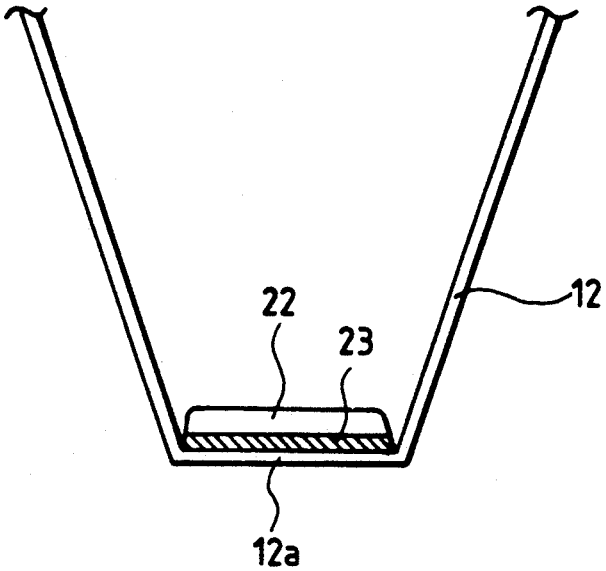
FIG. 4 is an enlarged side view of the cover assembly.

As shown in FIGS. 3A, 3B and FIG. 4, a sheet-like heat-fusible adhesive layer 22 made of a hot metal group, PE group, styrene group or acryl group and having a fusing point of 70~200° C. and a sheet-like heat generating layer 23 made of magnetic material are disposed on an inner surface of a back 12a of the cover member 12. The combination of the cover member 12, heat-fusible adhesive layer 22 and heat generating layer 23 is referred to as the "cover assembly".

The alternate magnetic field generation coils 16 can be activated with high frequency without the functional problem, but may be activated with the low frequency (preferably, 15~19 KHz, 30~38 KHz, 45~57 KHz) to obtain a good bound article.

The heat generating layer 23 may comprise a plate material rather than a paste mixed with magnetic powder, and preferably has a thickness of 0.01~0.5 mm. A case when the heat generating layer is made of 18.0 stainless steel, the thickness thereof is preferably 0.3~0.7 mm. If the thickness is too thin, since it is difficult to transfer the heat, there will arise a disadvantage regarding uniform heating; whereas, if the thickness is too great, since the rigidity thereof is increased, the handling of the cover assembly will be difficult.

Figure 5:
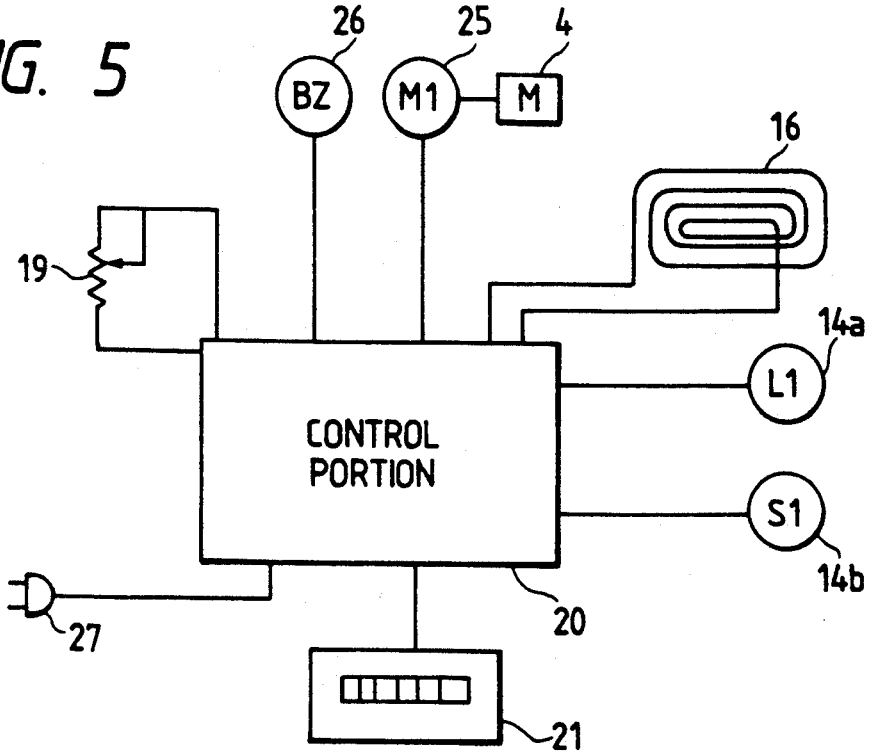
FIG. 5 is a block diagram for the sheet binder.

Next, a control block diagram shown in FIG. 5 will be explained.

In this control block diagram, electric power controlled by a control circuit for resonance output controlling the electric power in the control portion 20 is applied to the alternate magnetic field generation coils 16. When the cover member 12 is detected by the fact that the light receiver 14b does not receive the light from the light emitter 14a, the control portion 20 receives a detection signal and sends a signal to a motor driver 25 to drive the motor 4 so that the guide plates 3a, 3b are shifted to approach each other. By a resistance value signal from the variable resistor 19, a distance between outer surfaces of the cover member 12 is measured. When the resistance value of the variable resistor 19 becomes constant due to the slip in the torque limiter 5, the motor 4 is stopped.

The control portion 20 sets in a timer an energization time (heat time) period for the coils 16 in accordance with the resistance value signal from the variable resistor 19. When the heat time period for the coils has elapsed, a buzzer 26 is activated to alert that fact to an operator. Further, the time period set in the timer is displayed on the display 21.

Figure 6:
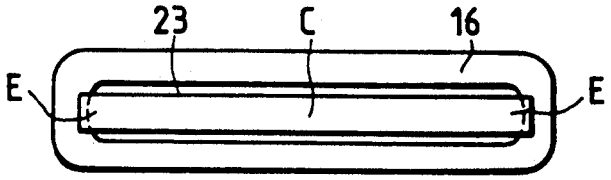
FIG. 6 is a plan view showing an example of how to wind a coil.

Next, the coil 16 will be explained with reference to FIG. 6. As shown in FIG. 6, in a rectangular coil 16, since the magnetic plate 23 is quickly heated at end portions E thereof and is slowly heated at its central portion C, it takes a long time until the central portion C of the magnetic plate 23 is adequately heated. In order to prevent damage to the back 12a of the cover member 12, the speed of the temperature increase is suppressed so that the heat time becomes 40~60 seconds (which is faster than the heat time of 90~120 seconds in the conventional heating plate type).

Figure 7A:
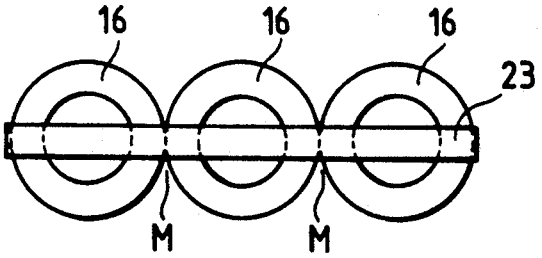
FIGS. 7A to 7C are plan views showing other examples of how to wind coils, respectively.
Figure 7B:
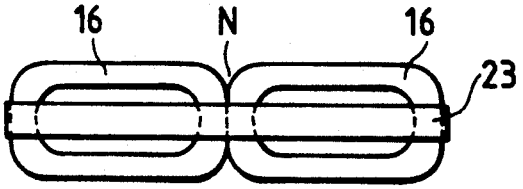

In this case, by arranging ring-shaped flat coils 16 side by side as shown in FIG. 7A or by arranging rectangular flat coils 16 side by side as shown in FIG. 7B (i.e., by dividing the coil assembly into a plurality of coils), the currents flow in reverse directions in adjacent portions M or N of two coils 16, thus permitting uniform heating of the magnetic plates 23. In such cases, although the low temperature areas are generated only along the portions M or N, since the temperature therein is not lower than that of the central portion C shown in FIG. 6, the uniformity of the heating is maintained so that the sheets can be bound only for 20~30 seconds.

Figure 7C:
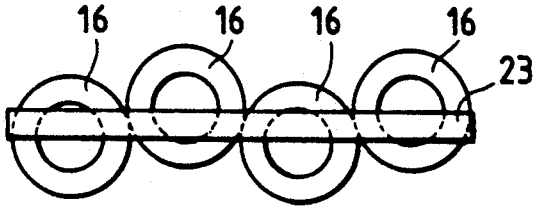

Further, as shown in FIG. 7C, by dividing the coils 16 in such a manner that they are overlapped with each other along the length of the magnetic plate 23, the low temperature areas are not clearly eliminated in the adjacent portions of the two coils.

Figure 8:
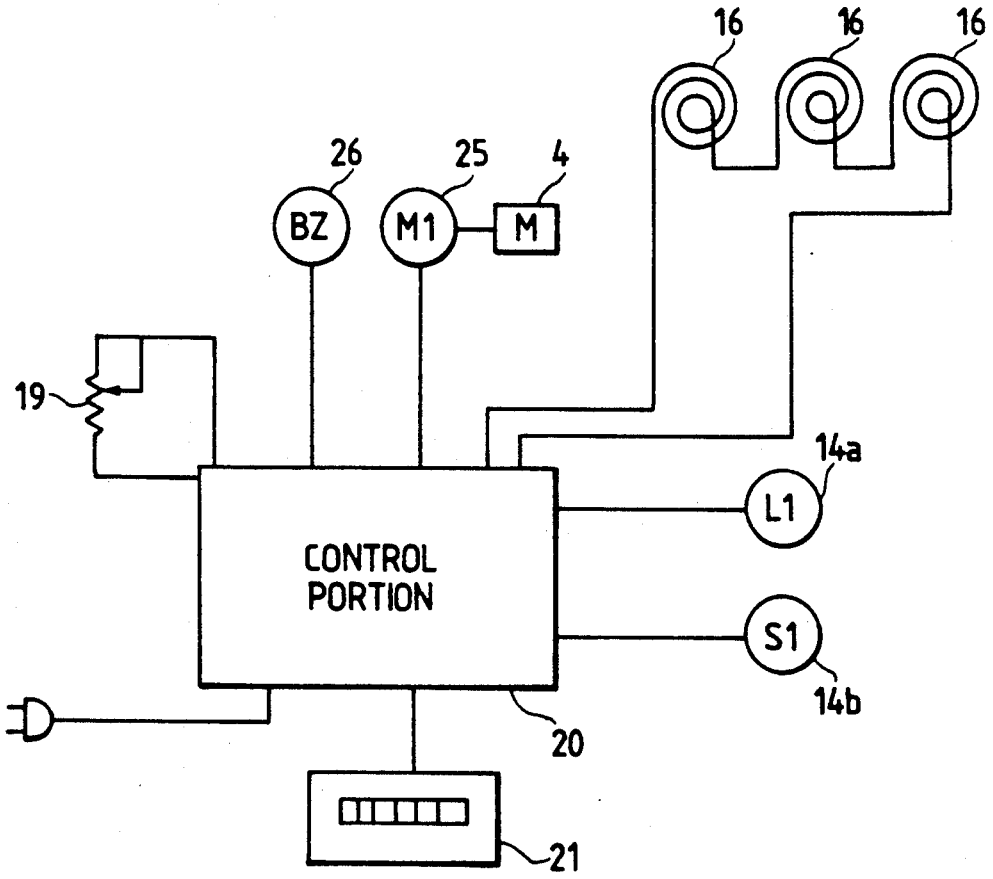
FIG. 8 is a view showing another block diagram for the sheet binder.

Incidentally, the divided coils can be interconnected in series or in parallel, but, preferably be interconnected in series as shown in FIG. 8 in view of the control facility and low manufacturing cost.

Figure 9:
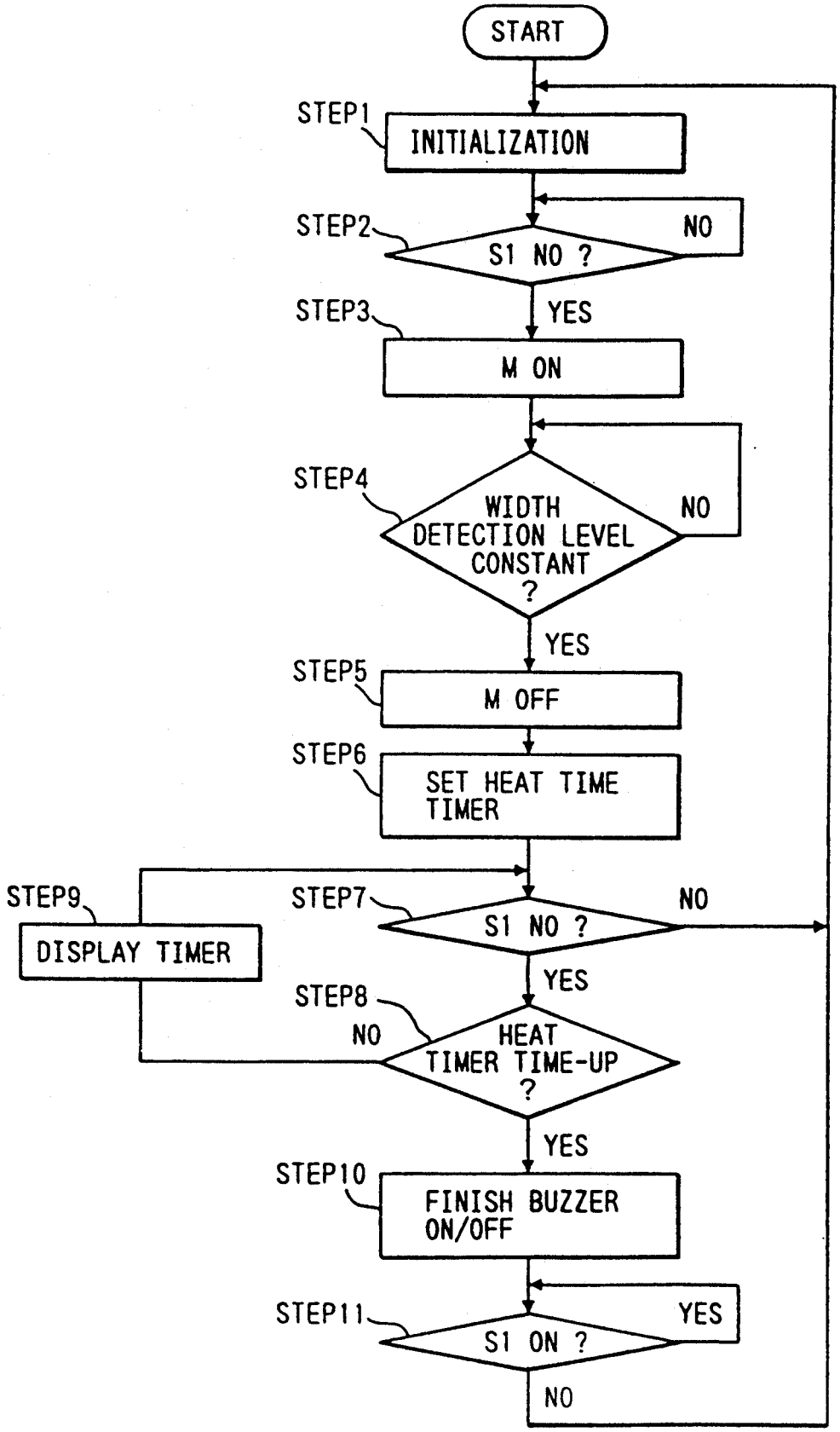
FIG. 9 is a flow chart showing a binding sequence.

Next, an operation of the sheet binder according to the illustrated embodiment will be explained with reference to a flow chart shown in FIG. 9.

When a plug socket 27 is connected to a power source, the control portion 20 activities the motor driver 25 to drive the motor 4, thereby establishing an initialization condition that the guide plates 3a, 3b are fully opened (step 1). Then, the cover member 12 is inserted between the guide plates 3a, 3b until the light from the light emitter 14a to the light receiver 14b is interrupted (step 2).

Then, when the cover member 12 is detected, the motor 4 shifts the guide plates 3a, 3b to approach each other (step 3). When the level of the resistance value signal of the variable resistor 19 becomes constant (step 4), the motor 4 is stopped (step 5). Further, the timer for energizing the coils 16 (i.e., heat time timer) is set in accordance with the constant resistance value signal of the variable resistor 19 (step 6).

In the illustrated embodiment, the set time is 30 seconds, for the total sheet thickness of 5~15 mm, 25 seconds for the total sheet thickness of 15~20 mm, and 20 seconds for the total sheet thickness of 20~50 mm.

During dielectric heating, it is always monitored whether the cover member 12 is removed from the guide plates 3*a*, 3*b* by means of the light receiver 14*b*; if removed, the energization of the coils 16 is stopped and the sequence is returned to the initialization condition of the step 1 (step 7). When the heat time is timed-up (step 8), the timer time is displayed on the display 21 (step 9) and the finish buzzer 26 is turned ON (step 10), and the sequence is under a waiting condition until the bound sheets are removed (step 11).

When the bound sheets are removed, the binding sequence is finished and the sequence returns to the initialization condition of step 1.

Figures 10, 11:
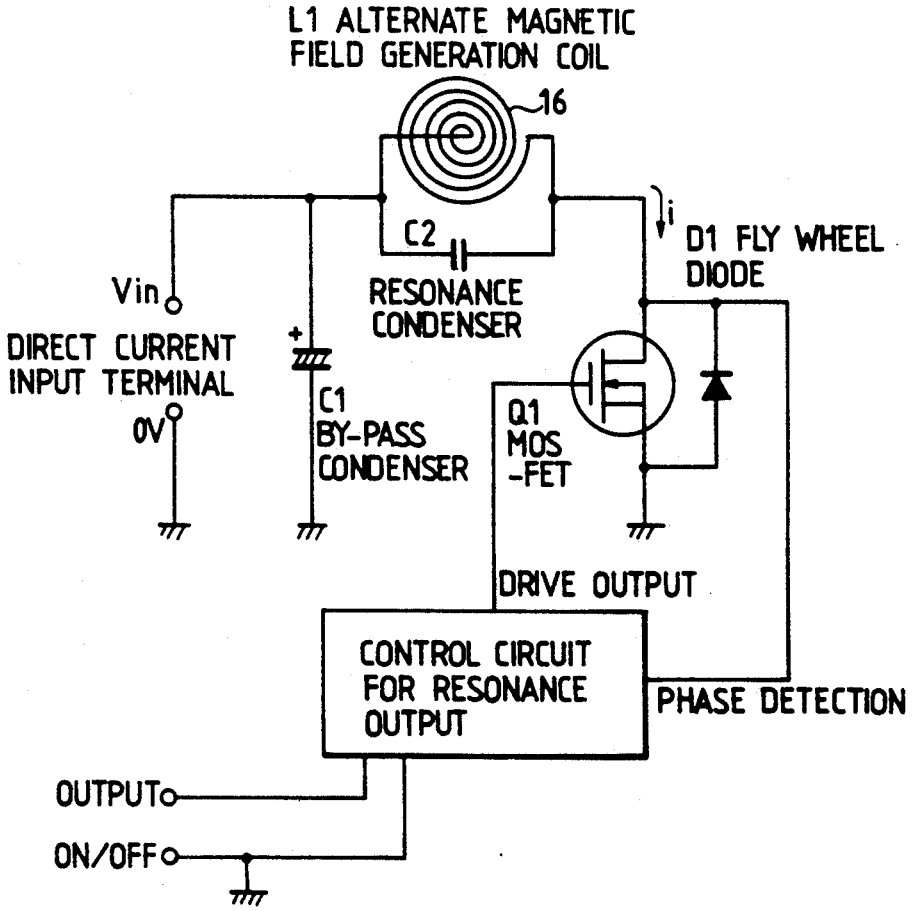
FIG. 10 is a table showing features of magnetic bodies.
FIG. 11 is a block diagram of an alternate magnetic field generation circuit.

FIG. 10 shows the character of the magnetic bodies. Various numerical values represented in the table of FIG. 10 were obtained from the test wherein various materials were tested under an alternate magnetic field of 20 KHz. Since, in the materials such as aluminum and copper, which have a relative permeability $\mu_r$ and surface resistance Rs greatly larger than those of iron, the heating value thereof is low and a large amount of the magnetic field is leaked outside. In the sheet binder according to the present invention, the magnetic bodies each having a relative permeability of a least 50 or more and the surface resistance of at least $3\times10^{-4}\,\Omega$ or more were used. As a result, the faster operability and the excellent efficiency of the sheet binder could be obtained.

Next, the above-mentioned surface resistance and relative permeability will be explained.

First of all, the surface resistance will be described.

Generally, the high frequency electric current flowing into the conductor including the magnetic body flows only on the surface layer of the conductor. Accordingly, the resistance to the high frequency electric current flowing into the tubular cylindrical conductor is the same as that flowing into the solid conductor.

The inherent vector impedance Z of the conductor in this case is represented by the following formula on the basis of Maxwell's equation:

$$Z=(1+j)\times\rho/\delta$$

Where, $\rho$ is the inherent resistance of the conductor ($\Omega\cdot$m), $\delta$ is the depth of permeation (m), and $\delta/\rho$ is called the surface resistance Rs ($\Omega$), and j is an imaginary number.

Next, the relative permeability will be explained.

The magnetic dipolar moment "magnetization IM" per unit area of the magnetic body which generates the magnetic polarization in the magnetic field IH is generally in proportion to the magnetic field IH. That is to say, $$IM=Xm\ IH[A/m]\ \text{(Xm is susceptibility)} \qquad (1).$$

The magnetic flux density IB obtained when the magnetic body is disposed in the magnetic field is represented as follows:

$$IB=\mu_0\,(IH+IM)\ (\mu_0\text{ is permeability in vacuum}) \qquad (2).$$

From the equations (1) and (2), $$IB=\mu_0\,IH\,(1+Xm)\ \mu_r\mu_0 IH=\mu IH[T]$$

Accordingly, $$\mu_r=\mu/\mu_0=1+Xm$$

Where, $\mu_r$ is relative permeability, $\mu$ is permeability of the medium.

Next, in the case where the excitation electric power and the excitation frequency are both constant, the magnetic field generating means will be explained with reference to a magnetic field generation circuit shown in FIG. 11.

The DC voltage obtained by rectifying the commercial AC power source is applied to Vin and 0V. C1 is a by-pass capacitor having a function for suppressing the fluctuation in the above-mentioned current and voltage, and L1 is an alternate magnetic field generating coil 16 acting as the alternate magnetic field generation circuit. A resonance capacitor (condenser) C2 having a predetermined resonance frequency is connected to the coil 16 in parallel.

The coil 16 and one of terminals of the capacitor C2 are connected to the voltage Vin, and the other terminal of the capacitor C2 is connected to a switching element Q1. The switching element Q1 is of the type that has low power consumption, high pressure tightness and high speed switching ability, such as MOS-FET and the like, and is so designed that it is turned ON or OFF in response to the output of the control circuit for resonance output of the control portion 20. A diode D1 is connected to the switching element Q1 in parallel.

The control circuit for resonance output has a circuit for activating the switching element Q1 and for detecting the resonance phase of a resonance circuit comprising the alternate magnetic field generation coil 16 and the resonance capacitor C2. Further, the control circuit for resonance output has a circuit for turning ON/OFF the magnetic field generated from the alternate magnetic field generation coil 16 in response to the control of the sheet binder 1.

Figure 12:
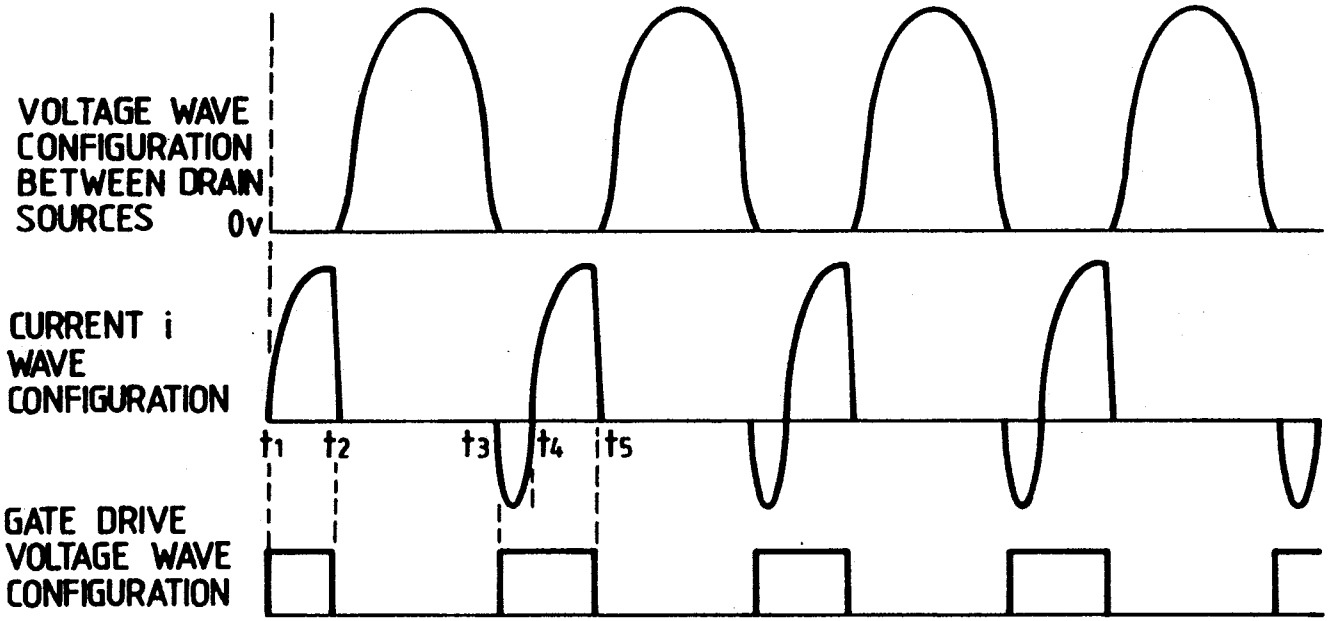
FIG. 12 is a view showing wave configurations generated by the circuit of FIG. 11.

Next, an operation of the magnetic field generating means will be explained with reference to FIG. 12.

When the output ON signal is input to the control circuit for resonance output, a gate of the switching element Q1 is activated. As a result, the current i starts to flow through the switching element Q1 so that the magnetic field is generated by the coil 16. When the gate is deactivated after a predetermined time period $t_2$ has been elapsed, the current i is stopped, and, by the resonance between the coil 16 and the resonance capacitor C2, the drain source voltage applied to the switching element Q1 is at first increased and then decreased. At a time $t_3$ when the drain source voltage becomes 0V, the gate is activated again by the circuit for detecting the resonance phase. At this point, the current i temporarily flows through the diode D1 in the negative direction due to the resonance between the coil 16 and the resonance capacitor C2. However, when the time $t_4$ is reached, the current flows through the switching element Q1 in the positive direction, so that the magnetic field is generated by the coil 16. At a predetermined time $t_5$, the gate is deactivated. Thereafter, the sequences from the time $t_2$ to the time $t_5$ are repeated. In this case, by controlling the time period between the times $t_2$, $t_5$, it is possible to obtain a predetermined oscillation frequency.

Next, examples of the cover assembly will be explained.

Figure 13:
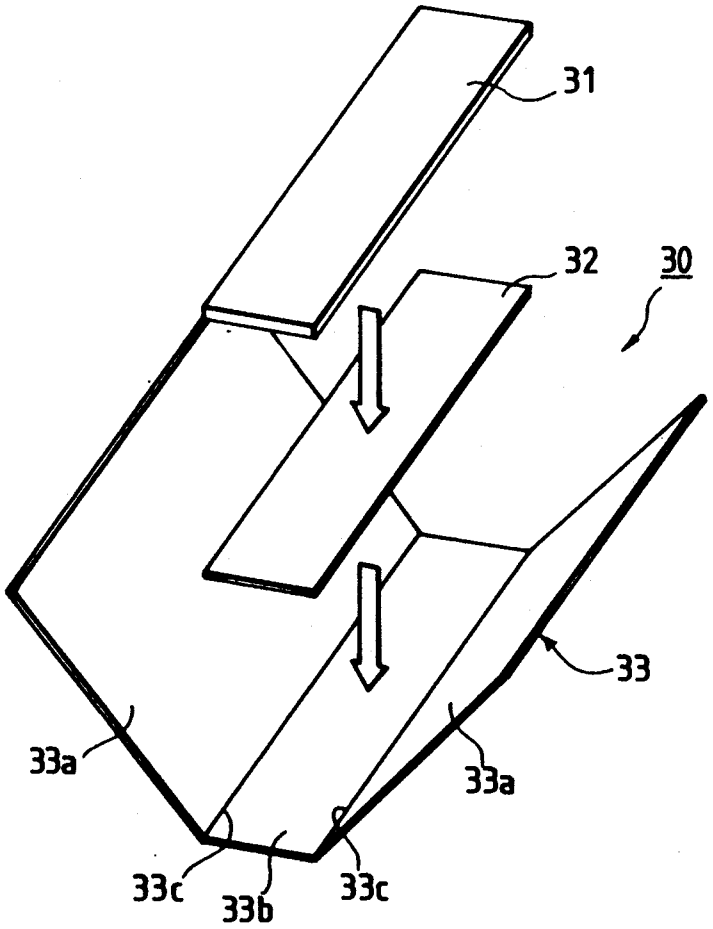
FIG. 13 is an exploded perspective view showing an example of a cover assembly.

FIG. 13 shows an example of the cover assembly 30. An elongated sheet-shaped heat-fusible adhesive layer 31 normally has a fusing point of about 70·100° C., but may have a fusing point of about 70~200° C. The adhesive layer is made of resin a included in the hot metal group, PE group, styrene group or acryl group, and, in an easy binding operation, the hot metal group resin is used frequently.

An elongated sheet-shaped magnetic plate 32 has a thickness of about 0.05~0.3 mm for the optimum efficiency, but may have a thickness of about 0.01~0.5 mm. If the thickness is too thin, since it is difficult to transfer the heat, uniform heating is difficult to be attained; whereas, if the thickness is too great, since the rigidity and weight thereof are increased, the handling of the cover assembly will be difficult.

Incidentally, it is preferable that a length and a width of the adhesive layer 31 are the same as those of the magnetic plate 32; however, if the width of the magnetic plate 32 is wider than that of the adhesive layer, there is no problem since the whole adhesive layer 31 can be heated.

Figure 14:
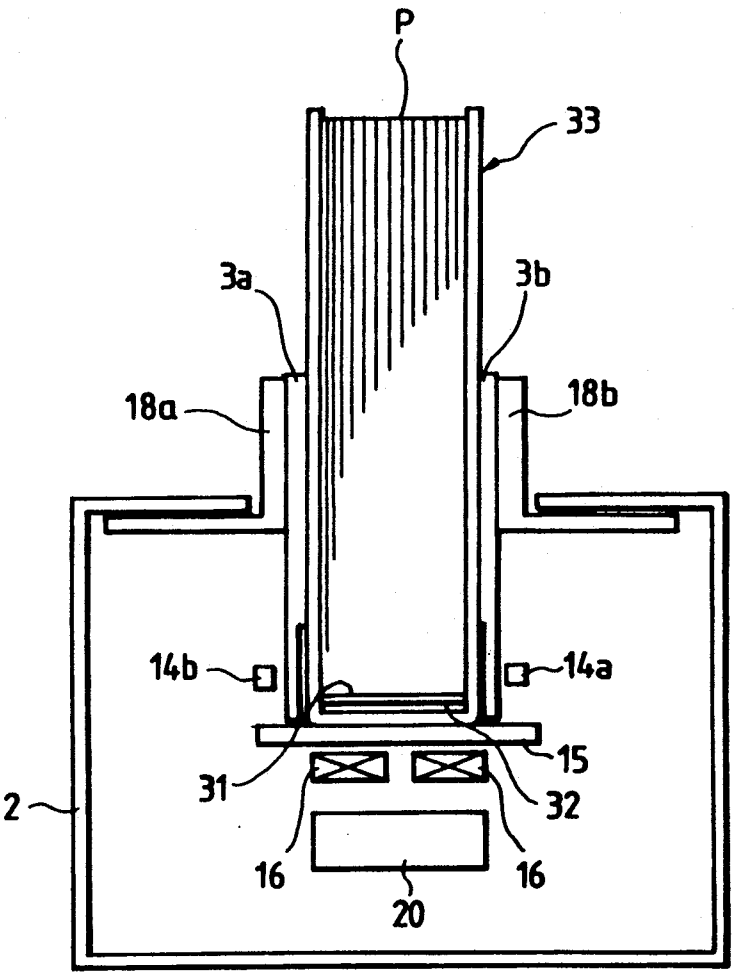
FIG. 14 is a sectional view of the sheet binder showing a condition that sheets are bound with the cover assembly of FIG. 13.

Further, a cover member 33 comprises front and rear cover portions 33*a* and a back portion 33*b*, and cutting lines are formed between these portions. Further, the heat-fusible adhesive layer 31 and the magnetic plate 32 are adhered to or fixed by eyelets to the back 33*b*, and the magnetic plate 32 is slightly shorter than the back 33*b* so that the former does not protrude from the latter. Incidentally, as shown in FIG. 14, a bundle of sheets P is rested on the heat-fusible adhesive layer 31 and is sandwiched between the front and rear cover portions 33*a*. In this condition, the sheets and the cover assembly are set in the sheet binder 1.

Figure 15:
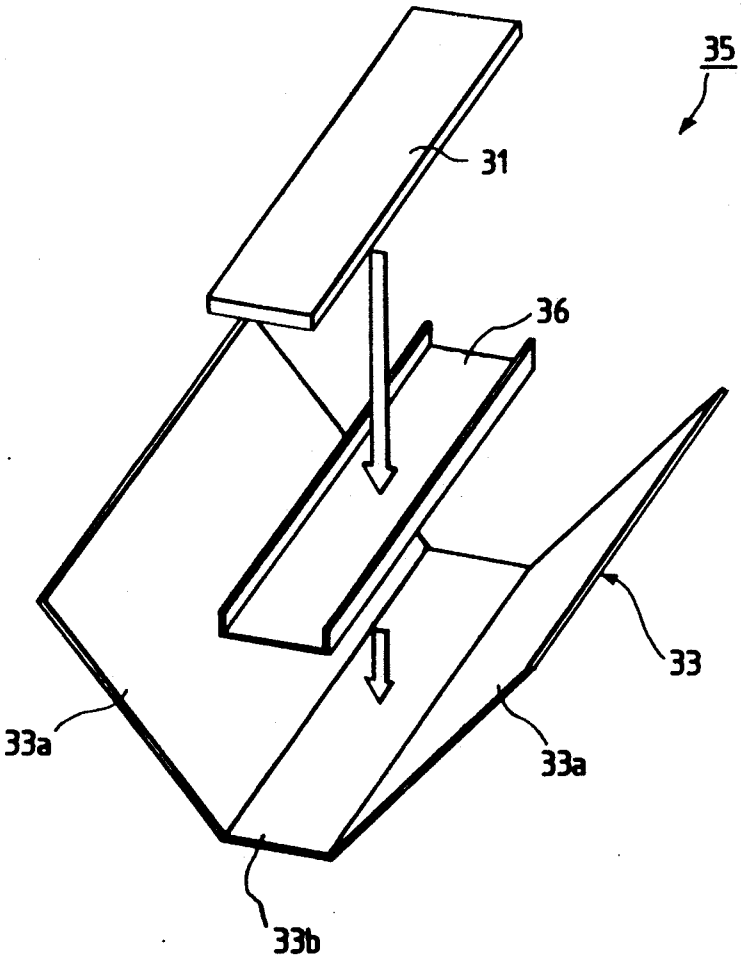
FIG. 15 is an exploded perspective view showing another example of a cover assembly.

In a cover assembly 35 shown in FIG. 15, since a magnetic plate 36 has a greater surface area by forming it in a laid U-shaped configuration, it can effectively receive the magnetic field generated by the coils 16. Accordingly, it is possible to fuse the heat-fusible adhesive layer 31 in a shorter time and to prevent leakage of the adhesive 31 in the transverse direction.

Figure 16:
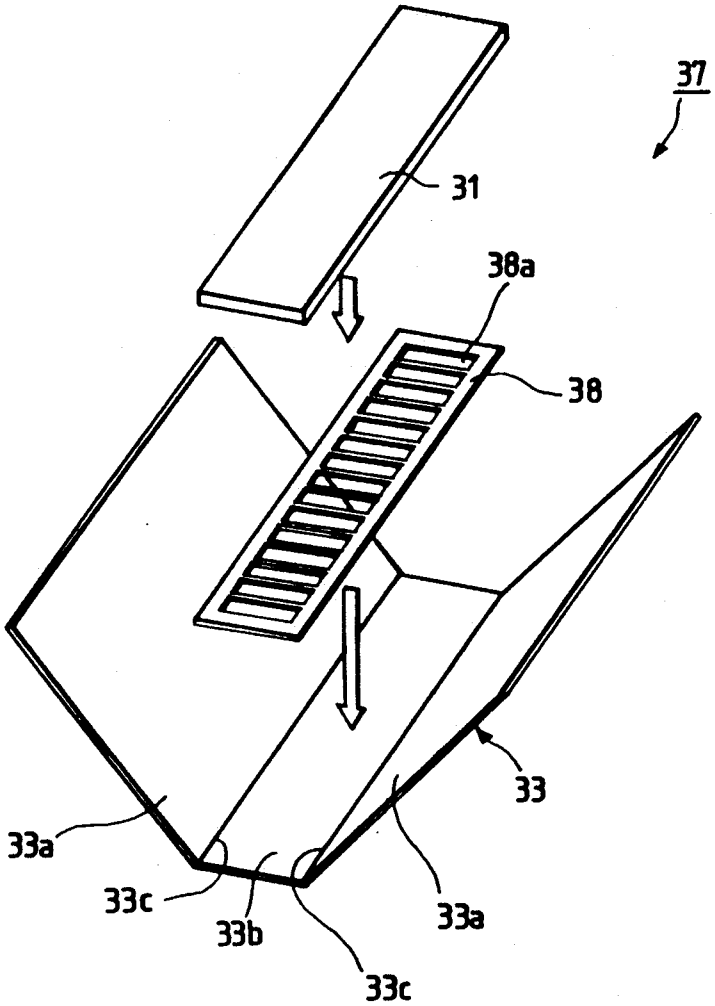
FIG. 16 is an exploded perspective view showing a further example of a cover assembly.

A cover assembly 37 shown in FIG. 16 differs from the cover assembly 30 shown in FIG. 13 in the point that a plurality of rectangular openings 38*a* are formed along a length of a magnetic plate 38. Incidentally, the configuration of the opening is not limited to the rectangular shape, but may be circular, elliptic or any other shape.

Figure 17A:
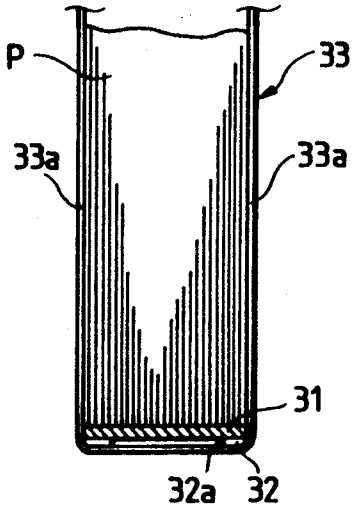
FIG. 17A is a sectional view showing a condition that the sheets are inserted into the cover assembly of FIG. 16.
Figure 17B:
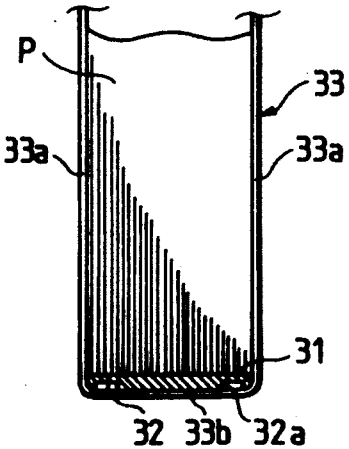
FIG. 17B is a sectional view showing a condition that the sheets have been bound by fusing an adhesive on the cover assembly by application of heat from the condition of FIG. 17A.

In a condition shown in FIG. 17A where the bundle of the sheets P is rested on the heat-fusible adhesive layer 31 and is sandwiched between the front and rear cover portions 33*a*, the sheets and the cover assembly are set in the sheet binder 1. By operating the sheet binder 1, the heat-fusible adhesive 31 is fused to penetrate into the openings 38*a* and is solidified there, so that the sheets P and the magnetic plate 38 and the inner surface of the back 33*b* of the cover member 33 are adhered to each other. This condition is shown in FIG. 17B.

Figure 18:
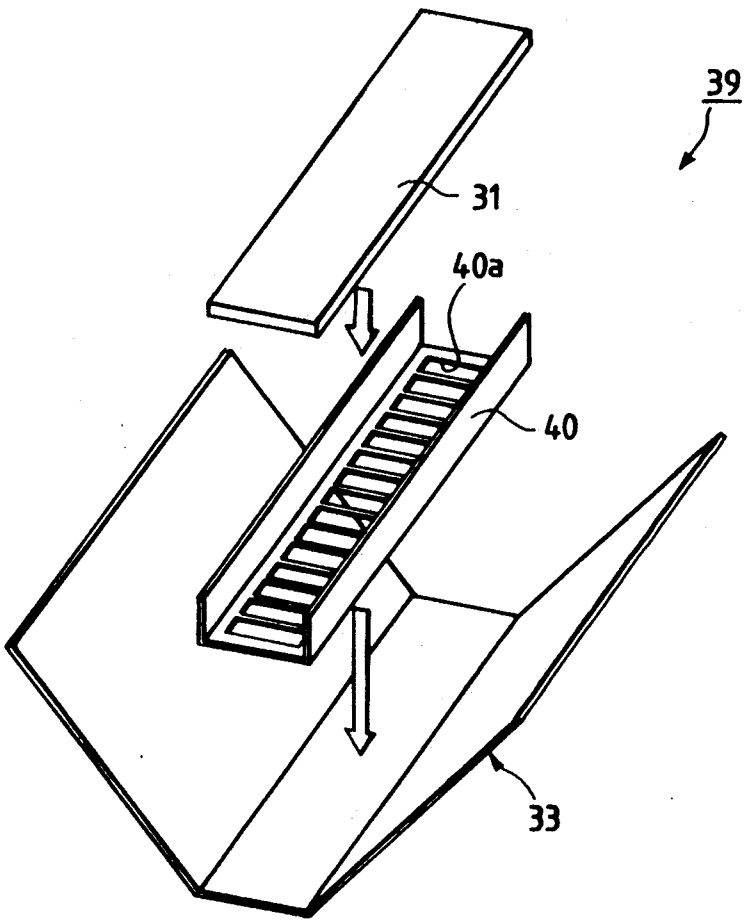
FIG. 18 is an exploded perspective view showing a still further example of a cover assembly.

In a cover assembly 39 shown in FIG. 18, in place of the magnetic plate 38 shown in FIG. 16, a magnetic plate 40 having a laid U-shaped configuration and a plurality of openings 40*a* is used. Since this magnetic plate has a wider surface area to effectively receive the magnetic field generated by the coils 16, the heat-fusible adhesive 31 can be fused in a shorter time. Further, the leakage of the adhesive 31 in the transverse direction can be prevented.

By using the cover assembly 37 or 39 shown in FIG. 16 or 18, since the heat-fusible adhesive 31 fused by the direct heating of the magnetic plate 38 or 40 due to the alternate magnetic field penetrates into the openings 38*a* or 40*a* formed in the plate 38 or 40 and adheres to the ends of the sheets and magnetic plate and the back of the cover member 33 and thereafter is solidified there, it is possible to save time for fixing the magnetic plate 38 or 40 and the heat-fusible adhesive layer 31 to the cover member 33.

Figure 20:
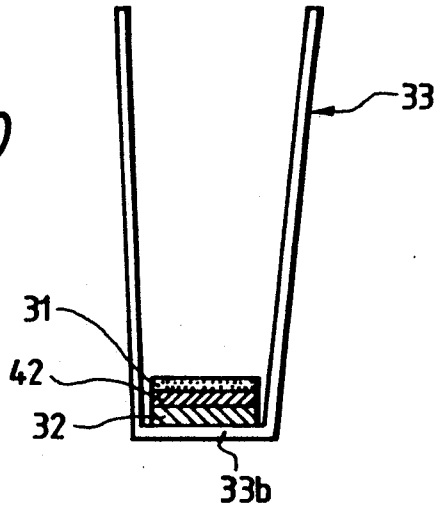
FIG. 20 is a sectional view of the cover assembly of FIG. 19.
Figure 19:
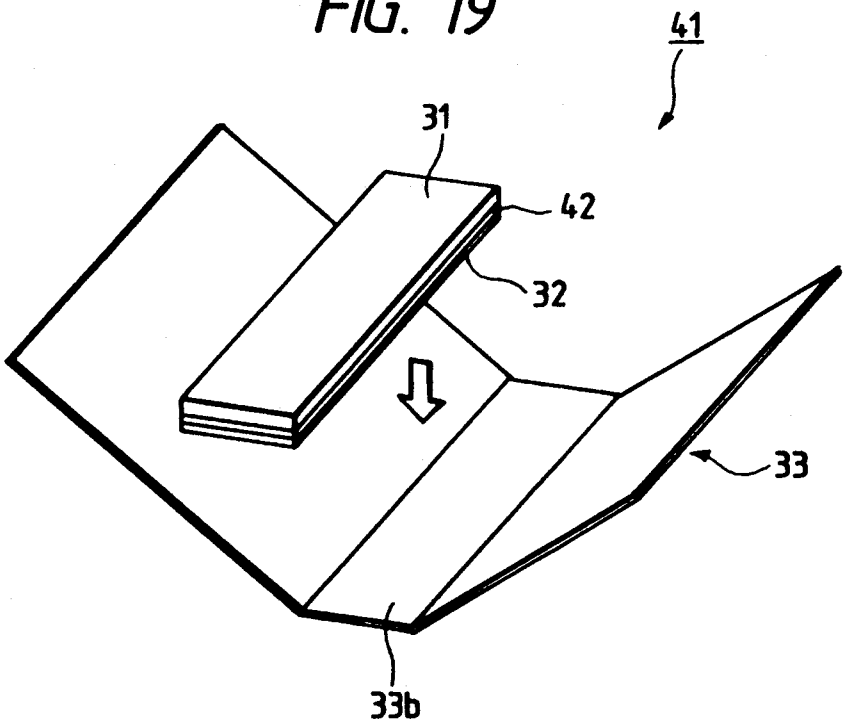
FIG. 19 is an exploded perspective view showing another example of a cover assembly.

In a cover assembly 41 shown in FIG. 19, a cover member 33 has a back 33*b*. As shown in FIG. 20, a magnetic plate 32, a good heat-conductive body 42 and a heat-fusible adhesive layer 31 are rested on the inner surface of the back 33*b* in order. The magnetic plate 32 is electromagnetically introduced by the low frequency magnetic flux generated by the introduction coils 16 of the sheet binder 1 and generates the heat due to the hysteresis loss and the eddy current.

Thus, the magnetic plate 32 is preferably made of a magnetic metal material such as iron, iron alloy such as stainless steel, or a ferromagnetic body such as aluminum, nickel, cobalt and the like, which has a faster heat generating speed.

Further, the thickness of the magnetic plate 32 is preferably 0.01~0.5 mm, and more preferably is 0.05~0.3 mm. If the plate is too thin, since it is difficult to transfer the heat in the longitudinal direction, uniform heating is worsened; whereas, if the thickness is too great, since the rigidity and the weight are increased, the handling of the cover assembly 41 will be difficult.

The good heat-conductive body 42 receives the heat generated in the magnetic plate 32 to distribute the heat uniformly and transmits it to the heat-fusible adhesive layer 31, and may be made of a good heat conductive metal such as aluminum, gold, silver, copper, magnesium, zinc and the like, or of an alloy such as brass. A thickness of the heat-conductive body 42 is preferably 0.01~0.5 mm. If the thickness is too great, the heat transfer speed in the thickness direction is worsened, thus lengthening the fusing time for the heat-fusible adhesive 31; whereas, if the plate is too thin, there arises a problem regarding the mechanical strength.

The heat-fusible adhesive 31 is an adhesive having as a main component synthetic resin such as polyethylene, polypropylene, ethylene vinyl acetate copolymer, polyester, polyamide, polyvinyl acetate copolymer and the like and having preferably a softening point of 70~100° C. The softening point of such a adhesive may be about 70~20° C. Further, the thickness of the adhesive layer is preferably 0.5~3 mm in view of the operability.

It is preferable that lengths and widths of the magnetic plate 32, good heat-conductive body 42 and heat-fusible adhesive layer 31 are the same as each other. Such lengths and widths are slightly shorter than those of the inner surface of the back 33*b* of the cover member 33 to prevent leakage of the heat-fusible adhesive from the cover member 33.

Further, a laminated layer comprising the magnetic plate 32, good heat-conductive body 42 and heat-fusible adhesive layer 31 may be attached to the back 33*b* of the cover member 33 by a heat-resistive adhesive or a heat-resistive adhesive both-surface tape, or by riveting.

Figure 21:
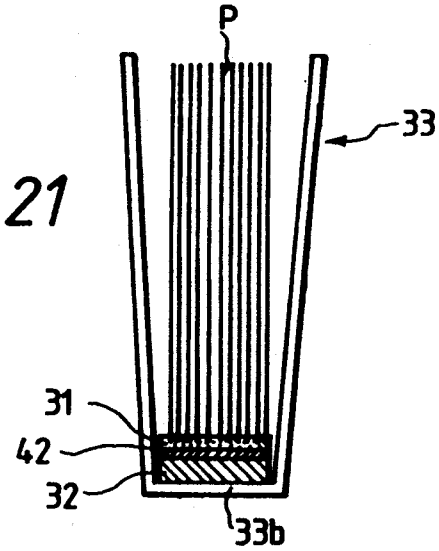
FIG. 21 is a sectional view showing a condition that the sheets have been bound with the cover assembly of FIG. 19.

As shown in FIG. 21, a bundle of sheets P is rested on the heat-fusible adhesive layer 31 disposed on the inner surface of the back 33*b* of the cover member 33, and then, the magnetic plate 32 is heated by the sheet binder 1 to fuse the heat-fusible adhesive 31 through the good heat-conductive body 42, and thereafter, the sheets P are fixedly adhered to each other by solidifying the adhesive. Since the good heat-conductive body 42 is attached to one surface of the magnetic plate 32, the local heat in the magnetic plate 32 is distributed uniformly on the good heat-conductive body 42 to be transmitted to the heat-fusible adhesive 31, the heat-fusible adhesive 31 can be fused uniformly and quickly.

In the illustrated embodiment, while the good heat-conductive body 42 was attached to one surface of the magnetic plate 32, such good heat-conductive bodies 42 may be attached to both surfaces of the magnetic plate. Incidentally, the magnetic plate 32 is not limited to the solid plate shape, but may include circular holes or longitudinal slits to suppress the local heating.

Further, although the magnetic plate, good heat-conductive body and heat-fusible adhesive layer may be previously adhered to the cover member 33 as shown in FIG. 20, the laminated layer comprising the magnetic plate 32, good heat-conductive body 42 and heat-fusible adhesive layer 31 may be rested on the back 33*b* of the cover member 33 during the adhering operation.

Lastly, a result of a sheet binding test using the cover member according to the illustrated embodiment will be described.

An adhesive consisting of an ethylene vinyl acetate copolymer group was coated by a thickness of 1 mm on the inner surface of the back of the cover member having a thickness of 0.3 mm. Then, a bundle of 300 sheets (A4 size) was rested on the inner surface of the back of the cover member, and the sheet binding operation was effected by using the conventional sheet binder of surface heating type. In this case, it took about 60 seconds until the binding operation was completed.

To the contrary, in accordance with the present invention, an iron foil (magnetic plate 32) having a thickness of 0.05 mm, an aluminum foil (good heat-conductive body 42) having a thickness of 0.015 mm and an ethylene vinyl acetate copolymer sheet (heat-fusible adhesive layer 31) having a thickness of 1.0 mm were adhered onto the inner surface of the back 33*b* of the cover member 33 having a thickness of 0.3 mm in order. Then, a bundle of 300 thin sheets (sheets P) was set, and the binding operation was effected by using the sheet binder 1 of electromagnetic induction heating type. In this case, for only 20 seconds, a good article could be obtained.

What is claimed is:

1. A sheet binder for binding sheets by adhering sheets to a back of a cover member, comprising:
   - a supporting member for supporting the cover member having the back, to an inner surface of which heat-fusible adhesive is applied;
   - a heat generating member for generating heat, being made of a magnetic material and disposed in said supporting member; and
   - alternate magnetic field generating means for generating an alternate magnetic field, and for applying the magnetic field to said heat generating member to cause said heat generating member to generate the heat.

2. A sheet binder according to claim 1, wherein said alternate magnetic field generating means comprises an induction coil.

3. A sheet binder according to claim 1, wherein an excitation frequency of the magnetic field generated by said alternate magnetic field generating means is set to have a value between one of 15 and 19 KHz, 30 and 38 KHz, and 45 and 57 KHz.

4. A sheet binder for binding sheets by adhering sheets to a back of a cover member, comprising:
   - a supporting member for supporting the cover member having the back, to an inner surface of which heat-fusible adhesive is applied;
   - thickness signal generating means for generating a signal indicative of thickness of the cover member supported by said supporting member;
   - a heat generating member for generating heat, being made of a magnetic material and disposed in said supporting member;
   - alternate magnetic field generating means for generating an alternate magnetic field, and for applying the magnetic field to said heat generating member to cause said heat generating member to generate the heat; and
   - control means for controlling an operation of said alternate magnetic field generating means on the basis of the signal generated by said thickness signal generating means.

5. A sheet binder according to claim 4, wherein said supporting member comprises a pair of guide members movable toward and away from each other, and said cover member is pinched and held by said guide members.

6. A sheet binder according to claim 5, wherein said thickness signal generating means comprises a variable resistor associated with the movement of said pair of guide members, and the thickness of said cover member is detected on the basis of a resistance value of said variable resistor.

7. A sheet binder according to claim 4, wherein said control means sets an operating time of said alternate magnetic field generating means longer, as said cover member becomes thicker.

8. A sheet binder for binding sheets by adhering sheets to a back of a cover member, comprising:
   - a supporting member for supporting the cover member having the back, to an inner surface of which heat-fusible adhesive is applied;
   - a heat generating member for generating heat being made of a magnetic material and being applied to the inner surface of the back of the cover member; and
   - alternate magnetic field generating means for generating an alternate magnetic field, and for applying the magnetic field to said heat generating member to cause said heat generating member to generate the heat.

9. A sheet binder according to claim 8, wherein said heat generating member has a flat plate configuration.

10. A sheet binder according to claim 8, wherein said alternate magnetic field generating means comprises an induction coil.

11. A sheet binder according to claim 10, further comprising a plurality of said induction coils, which are disposed along the length of said heat generating member.

12. A cover assembly comprising:
   - a cover member for pinching a bundle of sheets;

a heat-fusible adhesive provided on said cover member for adhering one side of the bundle of sheets to a back of said cover member; and a heat generating member being made of magnetic material and provided on said cover member for fusing said heat-fusible adhesive upon receiving an external alternate field.

13. A cover assembly according to claim 12, wherein said heat-fusible, adhesive and said heat generating member are one of integrally fixed to the back of said cover member and independently provided.

14. A cover assembly according to claim 12, wherein said heat generating member has a plate configuration.

15. A cover assembly according to claim 14, wherein said heat generating member has a plurality of openings formed therein and is independently formed from the back of said cover member and is disposed between said back and said heat-fusible adhesive.

16. A cover assembly according to claim 14, wherein said heat generating member has a laid U-shaped configuration having bent portions on both sides thereof.

17. A cover assembly comprising:

a cover member for pinching a bundle of sheets;

a heat-fusible adhesive provided on said cover member for adhering one side of the bundle of sheets to a back of said cover member;

a heat generating member being made of magnetic material and being provided on said cover member for fusing said heat-fusible adhesive upon receiving an external alternate field; and a good heat-conductive member disposed between said heat-fusible adhesive and said heat generating member.

18. A cover assembly according to claim 17, wherein said heat generating member and said good heat-conductive member have plate-shaped configurations, and said heat generating member, said good heat-conductive member and said heat-fusible adhesive are laminated in order from the back of said cover member.

19. A sheet binder for binding sheets by adhering sheets to a back of a cover member, comprising:

a supporting member for supporting the cover member having the back, to an inner surface of which heat-fusible adhesive is applied;

a heat generating member, made of a magnetic material, being applied to the inner surface of the back of the cover member;

thickness signal generating means for generating a signal indicative of thickness of the cover member supported by said supporting member;

alternate magnetic field generating means for generating an alternate magnetic field, and for applying the magnetic field to said heat generating member to cause said heat generating member to generate the heat; and control means for controlling said alternate magnetic field generating means on the basis of the signal generated by said thickness signal generating means.

* * * * *

UNITED STATES PATENT AND TRADEMARK OFFICE

CERTIFICATE OF CORRECTION

PATENT NO. : 5,219,453 Page 1 of 2

DATED : June 15, 1993

INVENTOR(S) : Furukawa, et al.

It is certified that error appears in the above-indentified patent and that said Letters Patent is hereby corrected as shown below: On title page, item

[73] ASSIGNEES:

"Canon Aptex Inc., Ibaraki," should read --Canon Aptex, Inc., Mitsukaido,--.

SHEET 7:

FIG. 10, "STEINLESS" should read --STAINLESS--.

COLUMN 1:

Line 9, "example" should read --as one example--.

COLUMN 3:

Line 52, "the" should be deleted.
Line 53, "the" should be deleted.
Line 59, "A" should read --In a--.
Line 62, "thickness" should read --plate--.

COLUMN 7:

Line 8, "70.100°C.," should read --70~100°C.,--.
Line 17, "thickness" should read --plate--.

UNITED STATES PATENT AND TRADEMARK OFFICE

CERTIFICATE OF CORRECTION

PATENT NO. : 5,219,453

DATED : June 15, 1993

INVENTOR(S) : Furukawa, et al.

It is certified that error appears in the above-indentified patent and that said Letters Patent is hereby corrected as shown below:

COLUMN 8:

Line 10, "plate" should read --magnetic plate--.
Line 56, "70~20°C." should read --70~200°C.--.

COLUMN 11:

Line 9, "heat-fusible," should read --heat-fusible--.

Signed and Sealed this

Fourteenth Day of June, 1994

Bruce Lehman

*Attest:*

BRUCE LEHMAN

*Attesting Officer*

*Commissioner of Patents and Trademarks*